US005350019A

United States Patent [19]

Igarashi

[11] Patent Number: 5,350,019

[45] Date of Patent: Sep. 27, 1994

[54] FIRE PROTECTION SYSTEM

[75] Inventor: Akira Igarashi, Tokyo, Japan

[73] Assignee: Nohmi Bosai Kogyo Kabushiki Kaisha, Tokyo, Japan

[21] Appl. No.: 68,309

[22] PCT Filed: Sep. 2, 1987

[86] PCT No.: PCT/JP87/00654

§ 371 Date: Dec. 4, 1987

§ 102(e) Date: Dec. 4, 1987

[87] PCT Pub. No.: WO88/01521

PCT Pub. Date: Mar. 10, 1988

Related U.S. Application Data

[63] Continuation of Ser. No. 408,431, Sep. 14, 1989, abandoned, which is a continuation of Ser. No. 141,663, Dec. 4, 1987, abandoned.

[30] Foreign Application Priority Data

Sep. 5, 1986 [JP] Japan ..... 61-210469

[51] Int. Cl.[5] ..... A62C 37/40

[52] U.S. Cl. ..... 169/61; 340/584

[58] Field of Search ..... 169/56, 60, 61; 340/584

[56] References Cited

U.S. PATENT DOCUMENTS

| | | | |
|---|---|---|---|
| 3,339,624 | 9/1967 | Cowgill | 169/61 X |
| 3,750,161 | 7/1973 | Teeters | 160/61 |
| 3,783,946 | 1/1974 | Petrinec et al. | 169/61 |
| 3,865,192 | 2/1975 | Dunphy | 169/61 |
| 3,949,812 | 4/1976 | Hay | 169/61 |
| 3,990,518 | 11/1976 | Hemme | 169/60 |
| 4,082,148 | 4/1978 | Willms | 169/61 |
| 4,262,286 | 4/1981 | Tanigawa | 169/61 X |
| 4,597,451 | 7/1986 | Moore et al. | 169/56 X |
| 4,688,644 | 8/1987 | Hemming | 169/61 |
| 4,691,783 | 9/1987 | Stem et al. | 169/61 |
| 4,741,403 | 5/1988 | Nishimura | 169/61 |

FOREIGN PATENT DOCUMENTS

| | | | |
|---|---|---|---|
| 2633103 | 1/1978 | Fed. Rep. of Germany | 169/60 |
| 201108 | 7/1983 | Fed. Rep. of Germany | 169/16 |
| 3711483 | 10/1988 | Fed. Rep. of Germany | 169/56 |
| 2305992 | 12/1976 | France | 169/56 |
| 1291162 | 2/1987 | U.S.S.R. | 169/61 |
| 1397046 | 5/1988 | U.S.S.R. | 169/23 |
| 8801521 | 3/1988 | World Int. Prop. O. | 169/61 |

*Primary Examiner*—David M. Mitchell
*Assistant Examiner*—Andrew C. Pike
*Attorney, Agent, or Firm*—Wenderoth, Lind & Ponack

[57] ABSTRACT

A a fire protection system controls terminal units, or devices which are connected to the terminal units, according to a predetermined control command through control circulars provided at the terminal units. The terminal units have timer circuits which work a predetermined timing operation in response to reception of the control command, whereby the terminal units or the devices to be controlled are controlled during the time interval determined by the timing operation.

3 Claims, 5 Drawing Sheets

FIRE PROTECTION SYSTEM

This application is a continuation of now abandoned application, Ser. No. 07/408,431, filed Sep. 14, 1989, which in turn is a continuation of now abandoned application, Ser. No. 07/141,663, filed Dec. 4, 1987.

TECHNICAL FIELD

The present invention relates to a fire protection system, and more particularly, it relates to a fire protection system employing the polling method, wherein the workload of a fire control panel (or control panel) is reduced when controlling the terminal units, and wherein the operations and accompanying changes of the object to be controlled can easily be carried out.

BACKGROUND TECHNOLOGY

Some conventional fire protection systems employ the polling method which causes the fire control panel to circularly call the terminal units in order to read from each of the called terminal units state information (presence or absence of an abnormality signal from an abnormality sensor, or ON/OFF of the control circuits for devices to be controlled) or to control the called terminal units.

The above-mentioned terminal units may be slave units having abnormality sensors (fire detectors, gas sensors etc.) and/or controlled devices (fire doors, smoke control devices, smoke venting devices, fire extinguishing systems, etc.) connected. Alternately, the terminal units may be the abnormality sensors or controlled devices themselves.

In the above-mentioned fire protection system the identification of the terminal units to be controlled and the time needed for the control are stored in advance in a memory means, such as ROM's, in the fire control panel so that the fire control panel may control the appropriate terminal units on the basis of data stored in the memory means in case of an abnormality, such as a fire or gas leak.

Presently there are various terminal units to be controlled, and the time required for their control varies with each terminal unit. For example, fire doors, emergency doors, smoke venting dampers and smoke control dampers are kept locked in position by electric locks. The electric locks are released by actuating the control circuits in the slave units for about ten seconds. The door or damper moves to the predetermined positions with the aid of door closers or their own weight.

For opening, closing and resetting of a motor driven fire shutter, smoke venting damper, or smoke control/-fire damper provided in the duct of an air conditioning system, it is necessary to operate the control circuits in the slave units for control of the motors, i.e. forward or reverse rotation of the motor for a certain length of time ranging from about ten seconds to a few minutes.

In case of a fire, the fire control panel (or control panel) sends the control start command to the terminal unit which is to be controlled and causes the control circuit in the terminal unit to operate. After the corresponding lapse of time required for control, the fire control panel sends the control termination command to the terminal unit to cease operation of the control circuit. As to these terminal units requiring reset of their controls after the extinguishment of the fire, the fire control panel sends the control start command at the time of reset start.

As can be seen from the above description, the time required for control varies, and this imposes a heavy workload on the fire control panel (or control panel) in the conventional system.

Moreover, there are also problems in that the contents stored in the memory means of the fire control panel need to be newly prepared for each installation of the fire alarm system and that whenever changes are made with respect to devices to be controlled, those stored contents have to be changed accordingly. Such preparation and changes are troublesome.

DISCLOSURE OF THE INVENTION

The present invention is made in view those problems involved in the conventional fire protection systems and with the objective of offering a fire protection system, such as a fire alarm system, which employs the polling method, which lessens the workload of the fire control panel when controlling the terminal units, and which can easily be adapted to changes of the devices to be controlled.

The present invention has been made to achieve the above objective. That is, the present invention provides a fire protection system to control the terminal units themselves or the devices to be controlled which are connected to the terminal units, according to a predetermined control command, through control circuits provided at terminal units, wherein the terminal units have a timer means which work a predetermined timing operation in response to reception of the control command, whereby the terminal units themselves or the devices to be controlled are controlled during the time interval determined by the timing operation.

BEST MODE FOR EMPLOYING THE INVENTION

Figure 1:
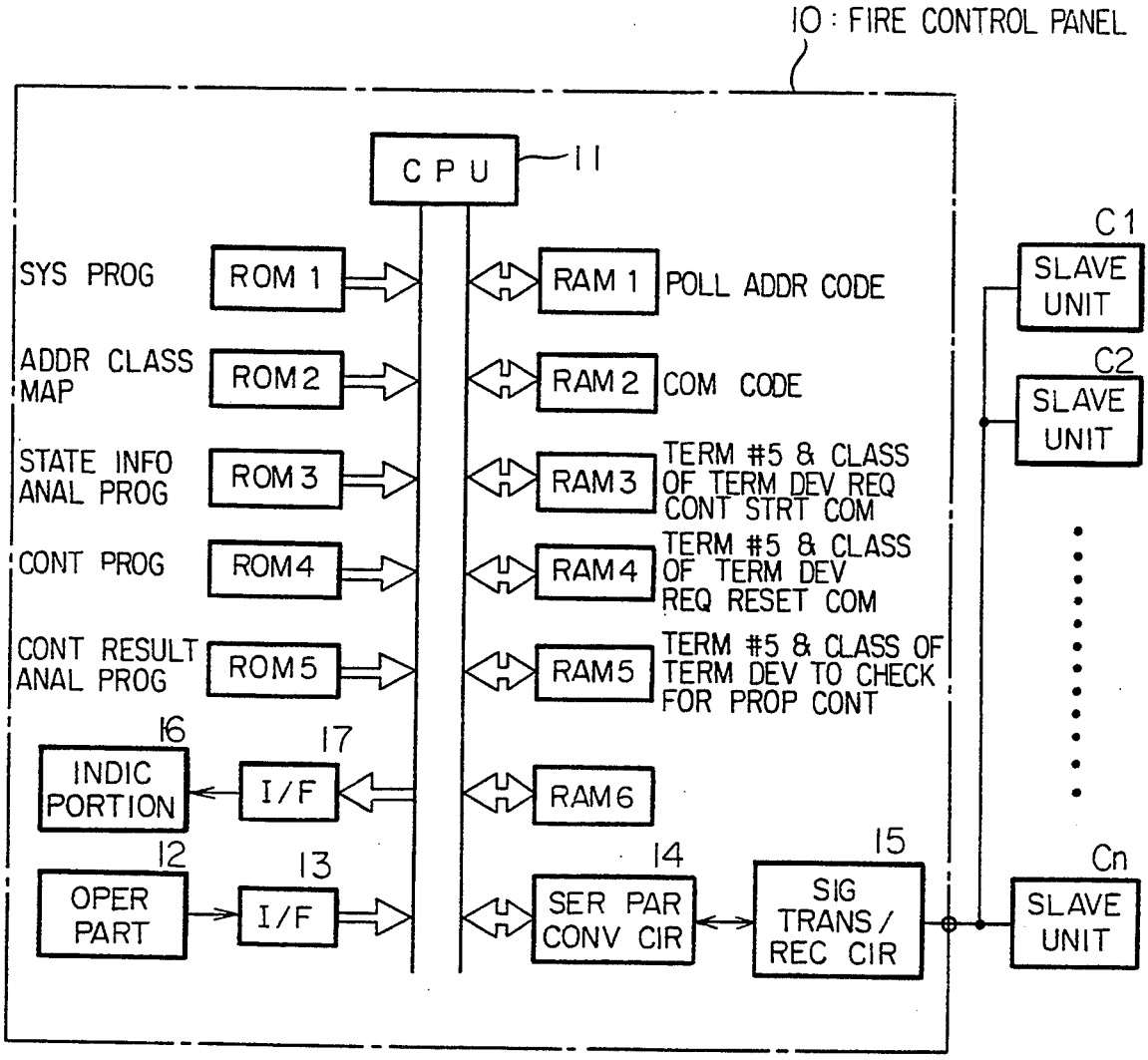
FIG. 1 is a block diagram showing the fire control panel in an embodiment according the present invention.

FIG. 1 is a block diagram showing an embodiment of the present invention. In FIG. 1 a fire control panel 10 is connected with slave units C 1, C 2 . . . C n. While devices other than the slave units C 1–C n may also be connected as terminal units, the slave units alone are shown in FIG. 1 as an example.

The fire control panel 10 is equipped with a CPU 11 for overall control, an operating part 12, an interface 13, a serial/parallel conversion circuit 14 which converts serial data to parallel data (and vice versa), a signal transmission/receiving circuit 15 for signal transmission and receiving, an indication part 16 for indication of the predetermined data, and an interface 17.

The fire control panel 10 is also equipped with a ROM 1, a ROM 2, a ROM 3, a ROM 4, a ROM 5, a RAM 1, a RAM 2, a RAM 3, a RAM 4 and RAM 5, which respectively stores the system program, the address classification map, the program for analyzing state information, the control program, the program for analyzing results of the control, the polling address, the command codes, the terminal numbers and classifications the terminal units to which the control state commands need to be sent, the terminal numbers and classifications of the terminal units to which reset commands need to be sent, the terminal numbers and classifications of the terminal units which need to be checked for proper control. The RAM 6 is for working.

Figure 2:
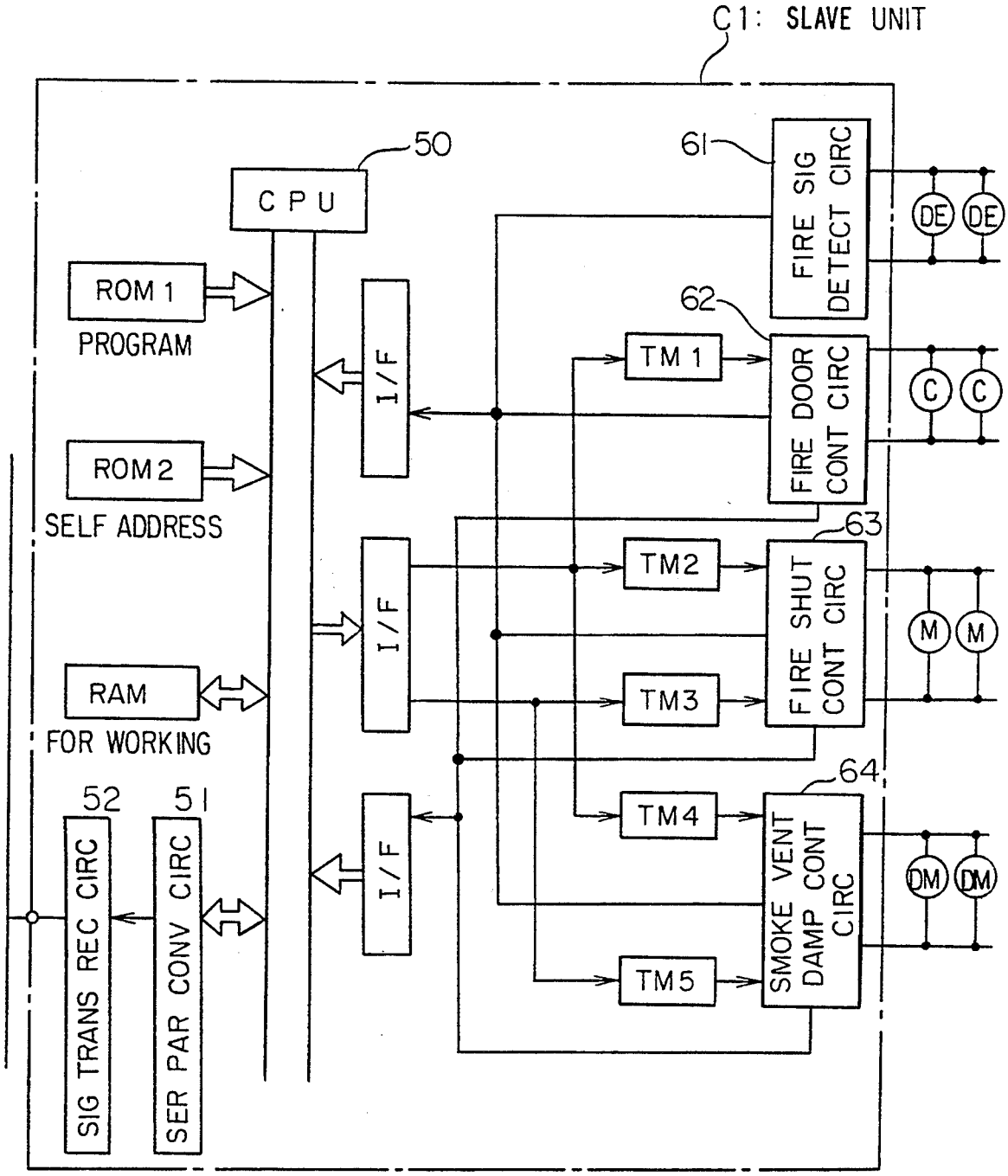
FIG. 2 is a block diagram showing the slave unit in the above embodiment.

FIG. 2 is a block diagram showing a concrete example of the slave unit C 1. The slave units C 2–C n, also have the same composition as that of the slave unit C 1. The slave unit C 1 is equipped with a fire signal detection circuit 61 which detects the fire signal from a fire detector DE, a fire door control circuit 62 which controls an electric clock C of a fire door, a control timer TM 1 for the fire door control circuit 62, a control circuit 63 which controls the forward/reverse rotation of a motor M for a fire shutter, a timer TM 2 which controls the forward rotation time of the motor M, a timer TM 3 which control the reverse rotation time of the motor M, a control circuit 64 which controls the forward/reverse rotation of a motor DM for the smoke venting damper, a timer TM 4 which controls the forward rotation of the motor DM, and a timer TM 5 which controls the reverse rotation of the motor DM.

The timers TM 1–TM 5 have their operating time set for the intended controls, for example, TM 1 has an operating time of 5 seconds, TM 2 of 60 seconds, TM 3 of 90 seconds and both TM 4 and TM 5 have 20 seconds.

The fire door control circuit 62, fire shutter control circuit 63 and smoke venting damper control circuit 64 are shown as examples of the control circuits which control the terminal units themselves or devices connected with and controlled by the terminal units. The fire door, fire shutter and smoke venting damper are shown as examples of controlled fire prevention/detection units or devices.

The timers TM 1–TM 5 are shown as examples of the timer means which are triggered the control command signal from the fire control panel and generate an output for a predetermined length of time. The output time of the timer means is adjustable.

Operation of the above embodiment is described hereinafter.

Figure 3:
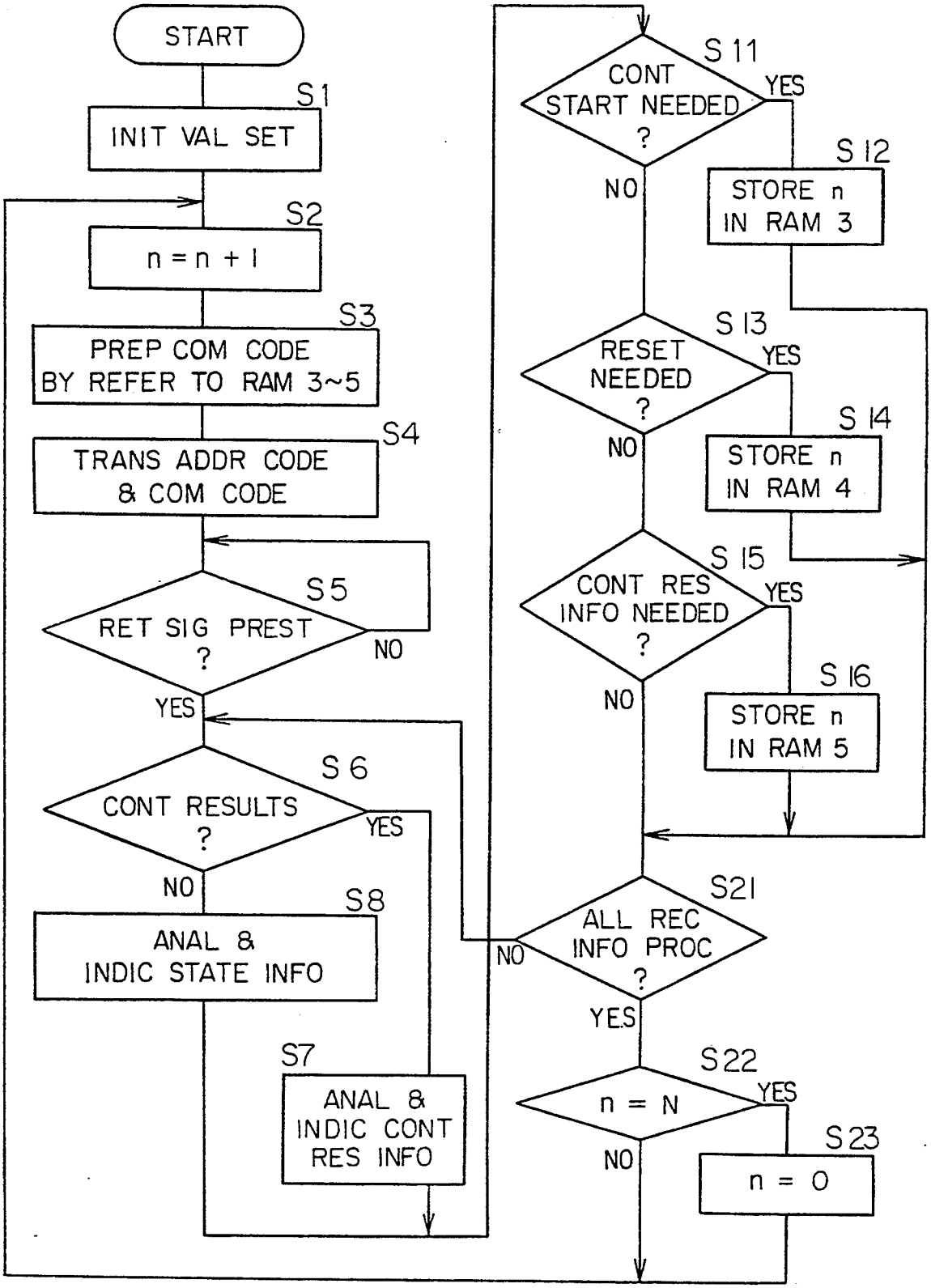
FIG. 3 is a flowchart showing the operation of the fire control panel in the above embodiment.

FIG. 3 is a flowchart showing the operation of the fire control panel 10.

In the fire control panel 10, an initial value is first set (S 1), a terminal number n (a terminal unit number, i.e. polling address) is incremented by one (S 2), and the terminal numbers and classifications stored in the RAM 3–RAM 5 are referred with respect to the terminal units to which the control start command, reset command and controls checking command, need to be sent. If there is the terminal number n in one of the RAM 3–RAM 5, a corresponding command code is prepared. In the absence of the terminal number n a command code requesting a state information is prepared (S 3). Then, the address code and the command code prepared in step (S 3) are sent to the terminal unit (S 4).

After this, if there is a return signal from the polled terminal unit (S 5) indicating a result of the control (S 6), this information the control result is analyzed by the analyzing program stored in the ROM 5, the result of which is indicated by means of the indication part 6 (S 7). If the return signal from the terminal unit does not represent a result of the control but rather a state of the terminal unit, the state information is analyzed by the analyzing program stored in the ROM 3 and indicated by means of the indication part 16 (S 8).

If it is necessary to start controlling a device such as the fire door (S 11) as a result of analyzation of the state information from the fire detector DE, the classification (classification of the controlled device) and the number n of the terminal unit are stored in the RAM 3 (S 12). If it is necessary to reset the controlled device (S 13), the classification and terminal number n of the controlled device are stored in the RAM 4 (S 14). If it is required to know a result of the control (S 15), the classification and terminal number n of the device to which the command for checking the control is stored in the RAM 5 (S 16).

These operations of S 6–S 16 are repeated until all the received information is processed (S 21). After processing all the received information, the above operations are repeated until the terminal number n reaches the set value N which represents the last terminal number. When the terminal number n matches the set value N, the terminal number n is set to 0 (S 23), and the operations return to the step S 2.

Now, operation of the slave unit C 1 described hereunder.

Figure 4:
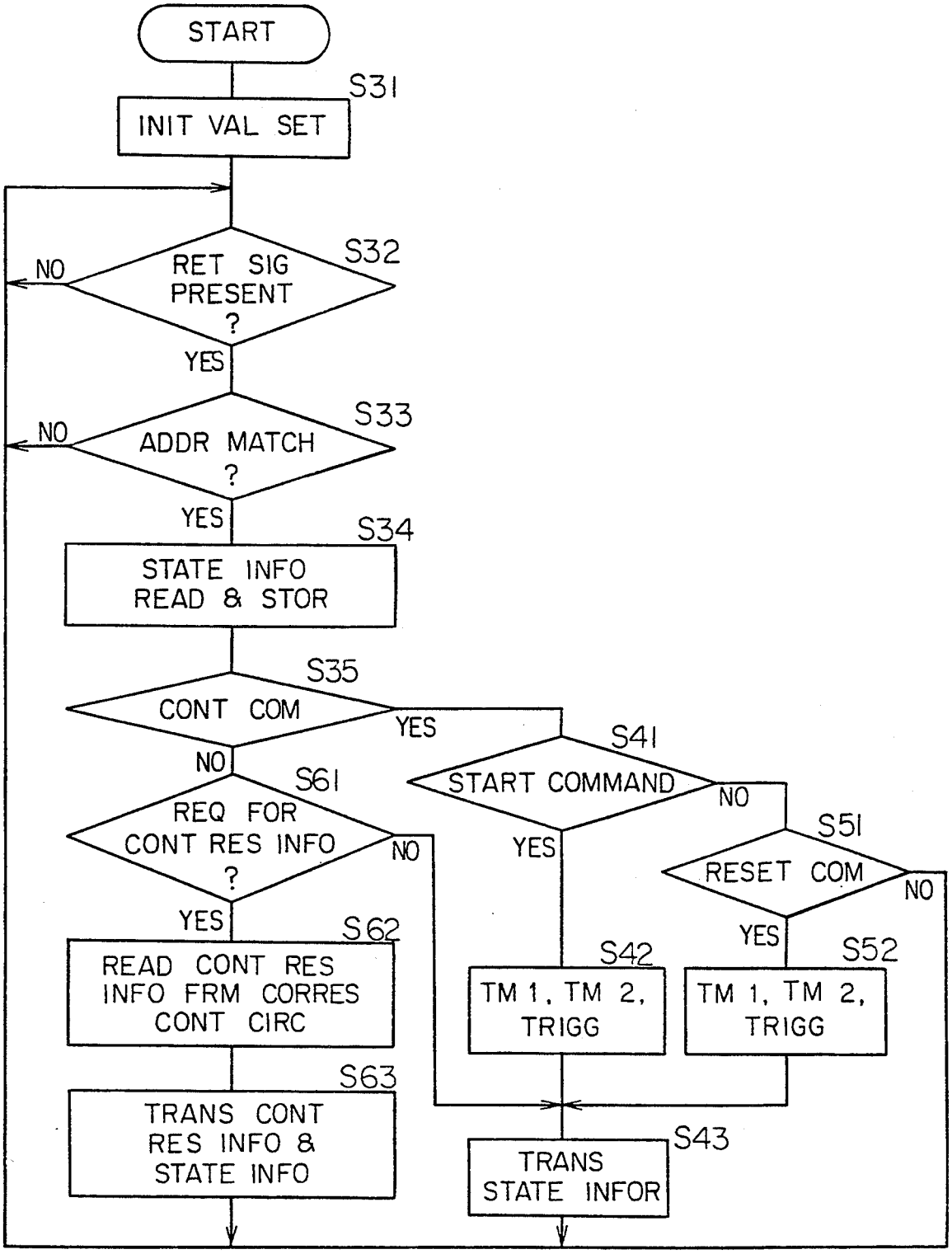
FIG. 4 is a flowchart showing the operation of the slave unit in the above embodiment.

FIG. 4 is a flowchart showing the operation of the slave unit C 1.

First, the initial value is set (S 31). If there is a return signal through the signal line (S 32), and yet the polling terminal number (polling address) in the return signal matches the terminal number stored in ROM 2 (S 33), the state information is stored. (S 34).

The state information includes data indicating whether or not there is a fire signal from the fire signal detecting circuit 61 and the ON/OFF state of each of the control circuits 62, 63, 64 for the fire door, fire shutter and smoke venting damper respectively.

Second, the command code in the return signal received from the fire control panel 10 is decoded. If this command code is a control command (S 35) and a control start command (S 41), the timers TM 1, TM 2, TM 4 are triggered (S 42) to send the state information of the detecting circuit 61 and control circuits 62–64 which have previously been read and stored at the step S 34 to the fire control panel 10 (S 43). With the outputs of the timers TM 1, TM 2, TM 4 the control circuits 62–64 are operated for a predetermined time to close the fire door and fire shutter and to open the smoke venting damper respectively.

On the other hand, if the control command is a reset command (S 51), the timers TM 3, TM 5 are triggered (S 52) to send the state information which has already been read and stored at the step S 34 to the fire control panel 10 (S 43). With the outputs of the timers TM 3, TM 5 the control circuits 63, 64 are operated for the predetermined time to open the fire shutter and to close the smoke venting damper respectively.

If the received command code is not a control command (S 35) but a request from the fire control panel 10 for information on results of the controls (S 61), the control results of the controlled devices (information as to open/close of the fire door, fire shutter and smoke venting damper) are read from the respective control circuits (S 62), and the information on the control results and the state information stored at the step S 34 are sent to the fire control panel 10 (S 63). In brief, information on results of the controls is given with respect to those controlled devices which need to be checked for their proper controls while state information of the control circuits is given with respect to those controlled devices which need not be checked for their controls. The the operation of the slave unit then returns to step S 32.

In the above embodiment each of the control circuits in the terminal units is provided with a control timer which is triggered by the command from the fire control panel and generates an output signal to the control circuit in the terminal unit for a predetermined length of time (time needed for control). With this arrangement the control of the above control circuits is completed by merely sending the control signal from the fire control panel to the corresponding terminal unit when such control is required due to a fire or some other accident, and there is no need for the fire control panel to manage the control time for each control circuit. This lessens the workload on the part of the fire control panel for control of the terminal unit to a large extent.

Further, by providing the control timers which control the operating time of the control circuits, it is possible to perform precise control of the control devices and to control each. terminal unit within the optimum length of time, and consequently power consumption for control can. be reduced.

Figure 5:
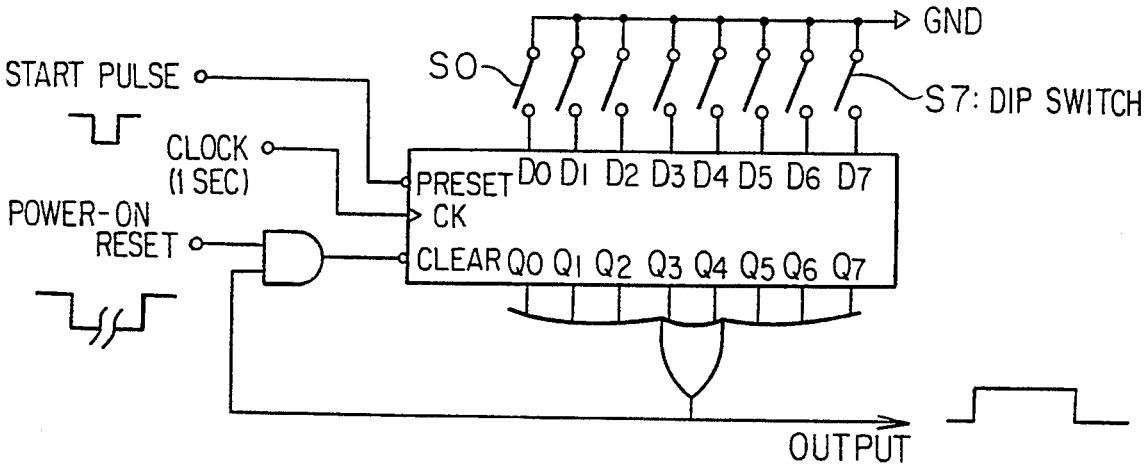
FIG. 5 is a circuit diagram showing an embodiment of the timer in the above embodiment.

FIG. 5 shows an example of the timers TM 1–TM 5, the output time of which can optionally be changed by means of the dip switches, thus they can be adapted to a device of the same kind having different control times (timer output time).

Figure 6:
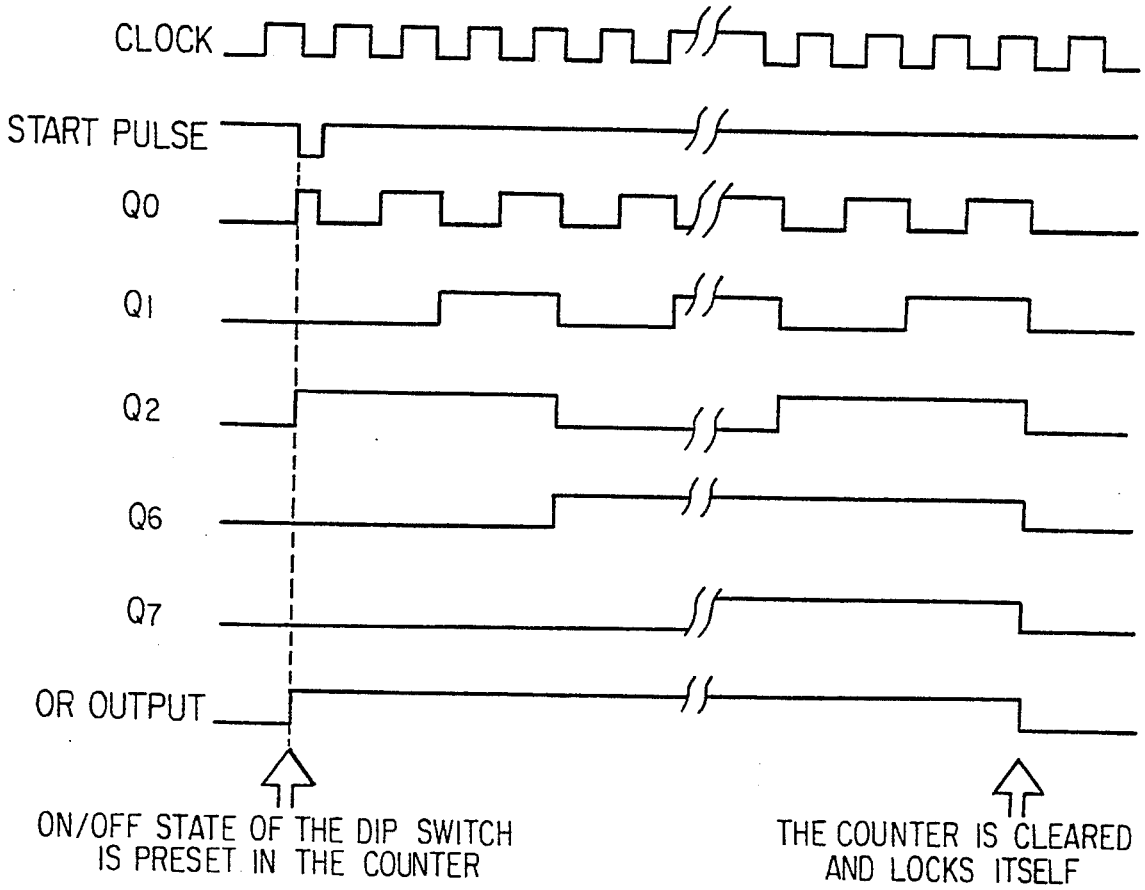
FIG. 6 is a time chart showing the operation of the timer shown in FIG. 5.

FIG. 6 is a time chart showing operation of the timers shown in FIG. 5. This time chart shows a case where an 8-bit binary counter with preset priority function is used.

The time T of the timer output (output of the OR circuit) is given by the following formula.

$$T=1\text{ sec.}\times\{2^8-(2^7 S7+2^6 S6+2^5 S5+2^4 S4+2^3 S3+2^2 S2+2^1 S1+2^0 S0)\}$$

Therefore, the length of the output time of the timer is variable within a range of 1 second to 255 seconds.

Although the numerical value indicated on the counter is indefinite at the time of turning on the power supply, it is set to zero by the power-on reset signal immediately after the power-on, and the output of the OR circuit reaches the L level, causing the counter to clear itself through the AND circuit and to lock in the cleared state.

Because of the preset priority function, the counter is released from the cleared state as the start pulse is applied, and the state (ON/OFF) of the dip switches S 0–S 7 is preset in the counter. After this, the counter keeps counting and again returns to and locks in the cleared state when overflowed (the output of all of Q 0–Q 7 reached the H level). Thus, the output of the OR circuit remains at the H level for the above T seconds, and consequently the counter circuit fulfills the function of the timer.

The start pulse is generated by the terminal unit CPU 50 upon receipt of the start command or reset command from the fire control panel and sent to the timer through I/F.

By providing each of the control circuits in the terminal unit with a control timer which is triggered by the command from the fire control panel and generates output to the control circuit for the predetermined length of time, the present invention has such effects that workload of the fire control panel at the time of control of the terminal units in the fire protection system employing the polling method is lessened, and work required for changes of devices to be controlled is readily performed.

What is claimed is:

1. A fire protection system comprising a control panel coupled to a plurality of slave units each equipped with a plurality of control circuits for respectively generating control signals to a plurality of fire prevention/detection units, each of said fire prevention/detection units being controlled according to said control signals received from a corresponding one of said control circuits, said slave units each being further equipped with timer means which is activated in response to a command received from said control panel to generate an output for a predetermined period of time, a duration of activation of at least one of said fire prevention/detection units being controlled according to said output from said timer means via said control circuits, said control panel including means for calling said slave units according to a polling method, said fire prevention/detection units including a fire detector, a fire door control device, a smoke venting control device and a fire shutter control device, wherein the command between said control panel and each corresponding slave unit is not maintained during the predetermined period of time in which said timer means of said each corresponding slave unit is activated in response to the command received from said control panel.

2. A fire protection system as set forth in claim 1, wherein said timer means includes a means for adjusting said predetermined period of time.

3. A fire protection system comprising a control panel coupled to a plurality of slave units each equipped with a plurality of control circuits for respectively generating control signals to fire prevention/detection devices connected to said slave units, said fire prevention/detection devices being controlled according to said control signals received from said control circuits, said slave units each being equipped with timer means which is activated in response to a command received from said control panel to generate an output for a predetermined period of time, a duration of activation of at least one of said fire prevention/detection devices being controlled according to said output from said timer means via said control circuits, and said control panel including means for calling said slave units according to a polling method, wherein the command between said control panel and each corresponding slave unit is not maintained during the predetermined period of time in which said timer means of said each corresponding slave unit is activated in response to the command received from said control panel.

* * * * *